US010502176B2

(12) United States Patent
Czekala et al.

(10) Patent No.: US 10,502,176 B2
(45) Date of Patent: Dec. 10, 2019

(54) SYSTEM AND METHOD FOR DELIVERING SPARK TO AN ENGINE

(71) Applicant: Ford Global Technologies, LLC, Dearborn, MI (US)

(72) Inventors: Michael Damian Czekala, Canton, MI (US); Garlan J. Huberts, Milford, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 642 days.

(21) Appl. No.: 13/804,443

(22) Filed: Mar. 14, 2013

(65) Prior Publication Data

US 2014/0102412 A1 Apr. 17, 2014

Related U.S. Application Data

(60) Provisional application No. 61/714,058, filed on Oct. 15, 2012.

(51) Int. Cl.

| | |
|---|---|
| ***F02P 5/145*** | (2006.01) |
| ***F02P 3/04*** | (2006.01) |
| ***F02P 3/045*** | (2006.01) |
| *F02P 15/00* | (2006.01) |
| *F02P 3/02* | (2006.01) |
| *F02P 1/08* | (2006.01) |
| *F02P 9/00* | (2006.01) |
| *F02P 15/08* | (2006.01) |

(52) U.S. Cl.

CPC ..... *F02P 5/145* (2013.01); *F02P 3/04* (2013.01); *F02P 3/045* (2013.01); *F02P 3/0456* (2013.01); *F02P 1/086* (2013.01); *F02P 3/02* (2013.01); *F02P 9/002* (2013.01); *F02P 15/008* (2013.01); *F02P 15/08* (2013.01)

(58) Field of Classification Search

CPC .. F02P 3/04; F02P 3/045; F02P 3/0456; F02P 15/008; F02P 1/086; F02P 5/145; F02P 9/002; F02P 15/08; F02P 3/02

USPC ..... 123/146.5 R, 149 FA, 406.12, 406.18, 123/609, 618, 620, 634, 636, 638, 640, 123/621–622

See application file for complete search history.

(56) References Cited

U.S. PATENT DOCUMENTS 3,505,563 A * 4/1970 Maycock ..... F02P 7/035 315/213
3,828,752 A * 8/1974 Hioki ..... F02D 21/08 123/640
3,885,541 A * 5/1975 Hufton ..... F02P 1/086 123/598

(Continued)

FOREIGN PATENT DOCUMENTS

GB 2138495 A * 10/1984 ..... F02P 3/0453
JP 2011064191 A * 3/2011
JP 2011-157864 A * 8/2011

*Primary Examiner* — Grant Moubry
*Assistant Examiner* — Joshua Campbell
(74) *Attorney, Agent, or Firm* — Geoffrey Brumbaugh; McCoy Russell LLP

(57) ABSTRACT

A system and method for delivering spark to an engine is disclosed. In one example, a single conductor carries a spark signal that is indicative of a desired spark advance for a plurality of ignition coils. The system and method may reduce wiring complexity for spark plugs that are supplied energy via two ignition coils.

13 Claims, 9 Drawing Sheets

(56) References Cited

U.S. PATENT DOCUMENTS 4,411,247 A * 10/1983 Kunita ..... F02P 15/08 123/655
4,463,744 A * 8/1984 Tanaka ..... F02P 15/08 123/630
4,483,295 A * 11/1984 Iida ..... F02D 37/02 123/406.21
4,493,307 A * 1/1985 Trinh ..... F02P 15/008 123/618
4,795,979 A * 1/1989 Kreft ..... F02P 15/08 123/643
4,892,080 A * 1/1990 Morino ..... F02P 3/005 123/604
4,938,200 A * 7/1990 Iwasaki ..... F02P 3/005 123/606
5,140,970 A * 8/1992 Akaki ..... F02P 3/053 123/620
5,193,515 A * 3/1993 Oota ..... F02P 3/0892 123/604
5,301,502 A * 4/1994 Oota ..... F01N 3/2006 60/284
5,333,593 A * 8/1994 Morganti ..... F02P 3/02 123/637
5,404,860 A * 4/1995 Morino ..... F02P 3/005 123/605
5,623,912 A * 4/1997 Kelly ..... F02P 3/0453 123/644
5,806,488 A * 9/1998 Imberg ..... F02D 41/0027 123/406.63
7,124,019 B2 * 10/2006 Goodell ..... F02P 17/12 324/388
2006/0201475 A1 * 9/2006 Shiraishi ..... F02D 41/3023 123/299
2009/0107457 A1 * 4/2009 Meyer ..... F02P 15/04 123/310
2009/0126710 A1 5/2009 Alger, II et al.
2010/0206267 A1 * 8/2010 Glugla ..... F02D 35/021 123/406.26
2011/0094475 A1 * 4/2011 Riegel ..... F02D 37/02 123/406.23

* cited by examiner

SYSTEM AND METHOD FOR DELIVERING SPARK TO AN ENGINE

CROSS REFERENCE TO RELATED APPLICATIONS

The present application claims priority to U.S. Provisional Patent Application No. 61/714,058 filed on Oct. 15, 2012, the entire contents of which are incorporated herein by reference for all purposes.

FIELD

The present description relates to a system and method for delivering spark to a spark ignited engine. The system and method may be particularly useful for engines that operate lean or with dilute mixtures.

BACKGROUND AND SUMMARY

An engine may be operated with a lean air-fuel mixture or diluted (e.g., via exhaust gas recirculation (EGR)) to improve engine fuel economy and/or emissions. However, combustion stability may be reduced when an engine is operated with a lean or diluted mixture. One way to improve combustion stability for an engine that is operated lean may be to increase spark energy. Spark energy may be increased via increasing the inductance of a coil supplying spark to the engine via a spark plug. Nevertheless, increasing coil inductance can increase coil charging time, and higher inductance coils may reduce ignition system efficiency for conditions when increased amounts of spark energy may not be desired (e.g., during combustion of a stoichiometric mixture). These and other short comings of single coil ignition systems may be overcome by supplying spark to a spark plug via two ignition coils. The two ignition coils may be charged and/or discharged at different times to increase spark duration and energy, but operating two ignition coils for each spark plug at different times may significantly raise a number of controller outputs and wires. Consequently, a dual coil per spark plug system may improve combustion stability, but it may also increase system cost, complexity, and assembly time.

The inventors herein have recognized the above-mentioned disadvantages and have developed a method for providing spark to an engine, comprising: supplying two different ignition coil dwell times via a single conductor, the two different dwell times supplied to a first ignition coil and a second ignition coil; and discharging the first ignition coil and the second ignition coil to a single spark plug.

By encoding ignition coil commands, it may be possible to reduce a number of conductors in an engine ignition system. In one example, ignition coil commands for one ignition coil are based on pulse widths that are greater than a first predetermined time. Ignition coil commands for a second ignition coil are based on pulse widths that are less than a second predetermined time. The two different pulse widths may be transmitted over a single conductor to operate two ignition coils supplying energy to a single spark plug.

In another example, commands for a first ignition coil may be transmitted over a first conductor while commands for a second ignition coil may be transmitted over a second conductor. The second conductor may also carry commands for a plurality of other ignition coils supplying energy to spark plugs in other engine cylinders. Thus, fewer conductors carrying ignition coil signals than ignition coils may be incorporated into an ignition system. As a result, ignition system wiring complexity may be reduced.

The present description may provide several advantages. In particular, the approach reduces ignition system wiring complexity. Further, the approach may reduce ignition system assembly time. Further still, the approach may reduce ignition system cost.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an example, referred to herein as the Detailed Description, when taken alone or with reference to the drawings, where.

DETAILED DESCRIPTION

Figure 1:
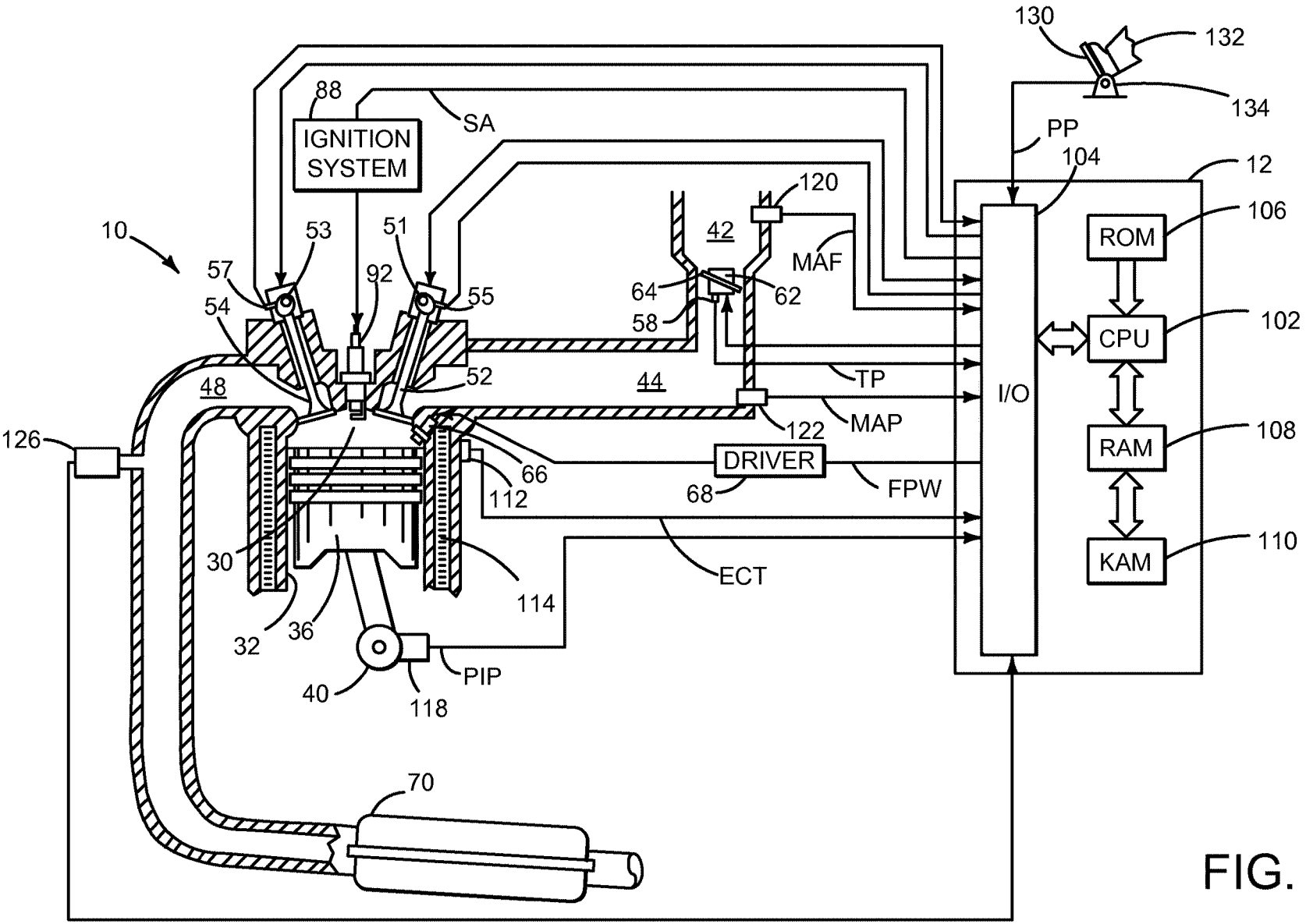
FIG. 1 is a schematic diagram of an engine.
Figure 2:
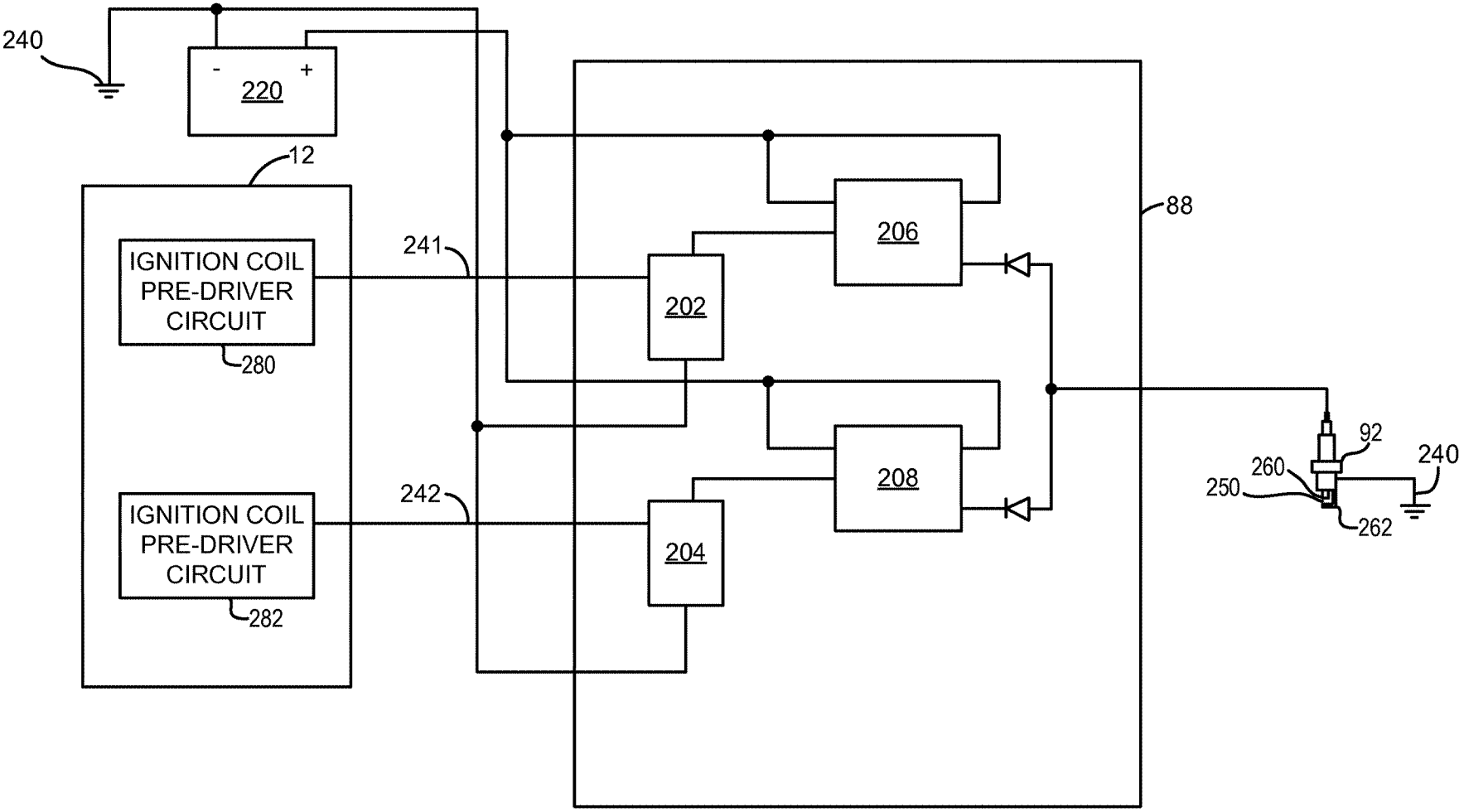
FIG. 2 PRIOR ART
FIG. 2 is a schematic diagram of a prior art ignition system.
Figure 3:
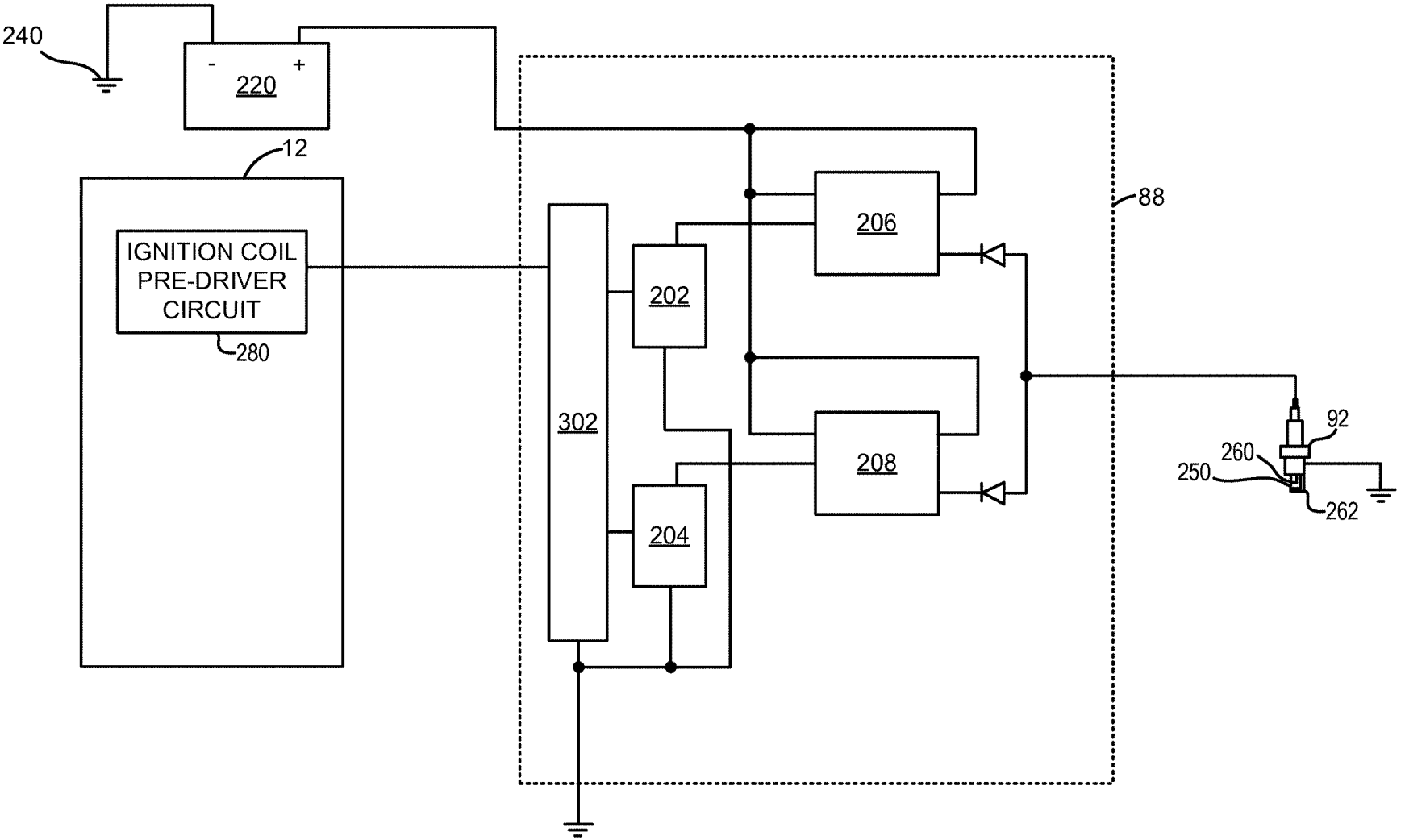
FIG. 3 shows an example schematic diagram for a first ignition system.
Figure 4:
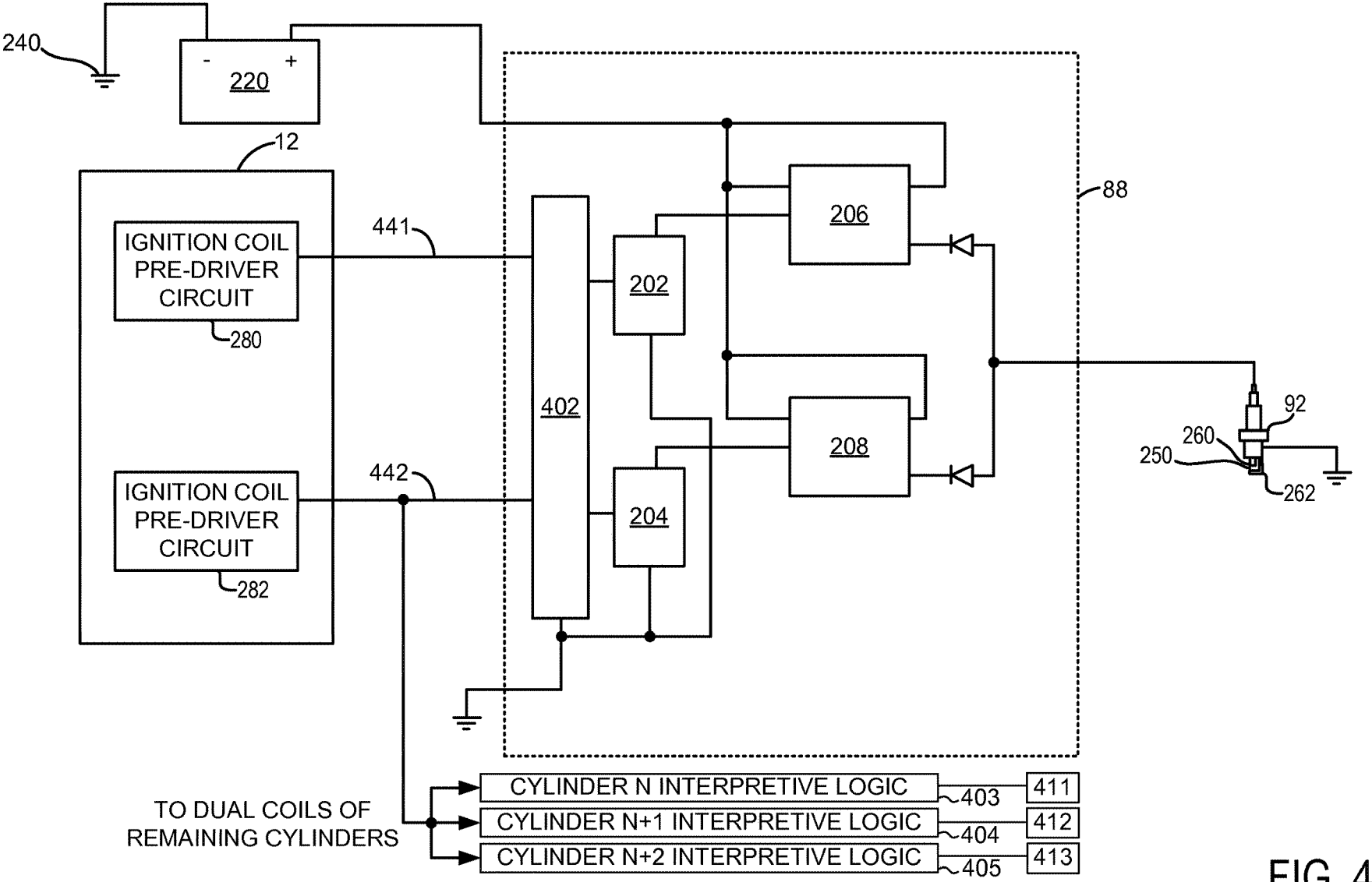
FIG. 4 shows an example schematic diagram for a second alternative ignition system.
Figure 5:
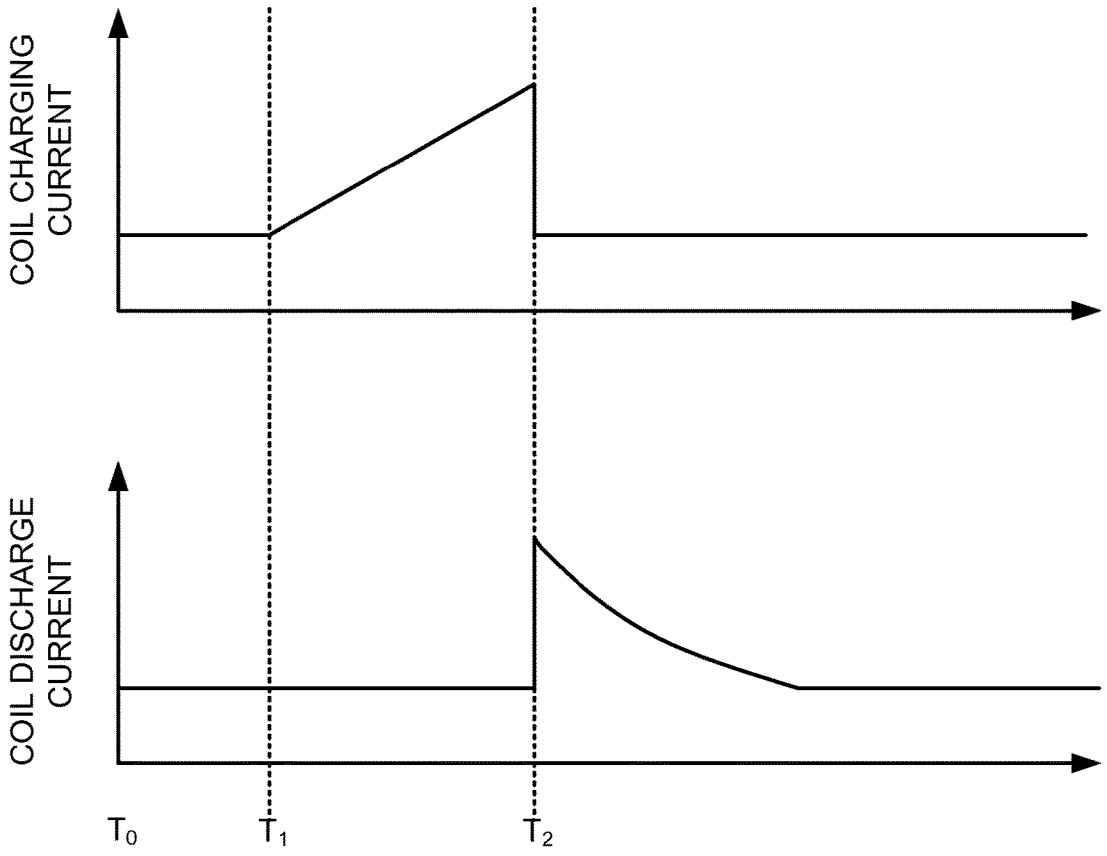
FIG. 5 shows example signals of a sole ignition coil supplying electrical energy to a spark plug.
Figure 6:
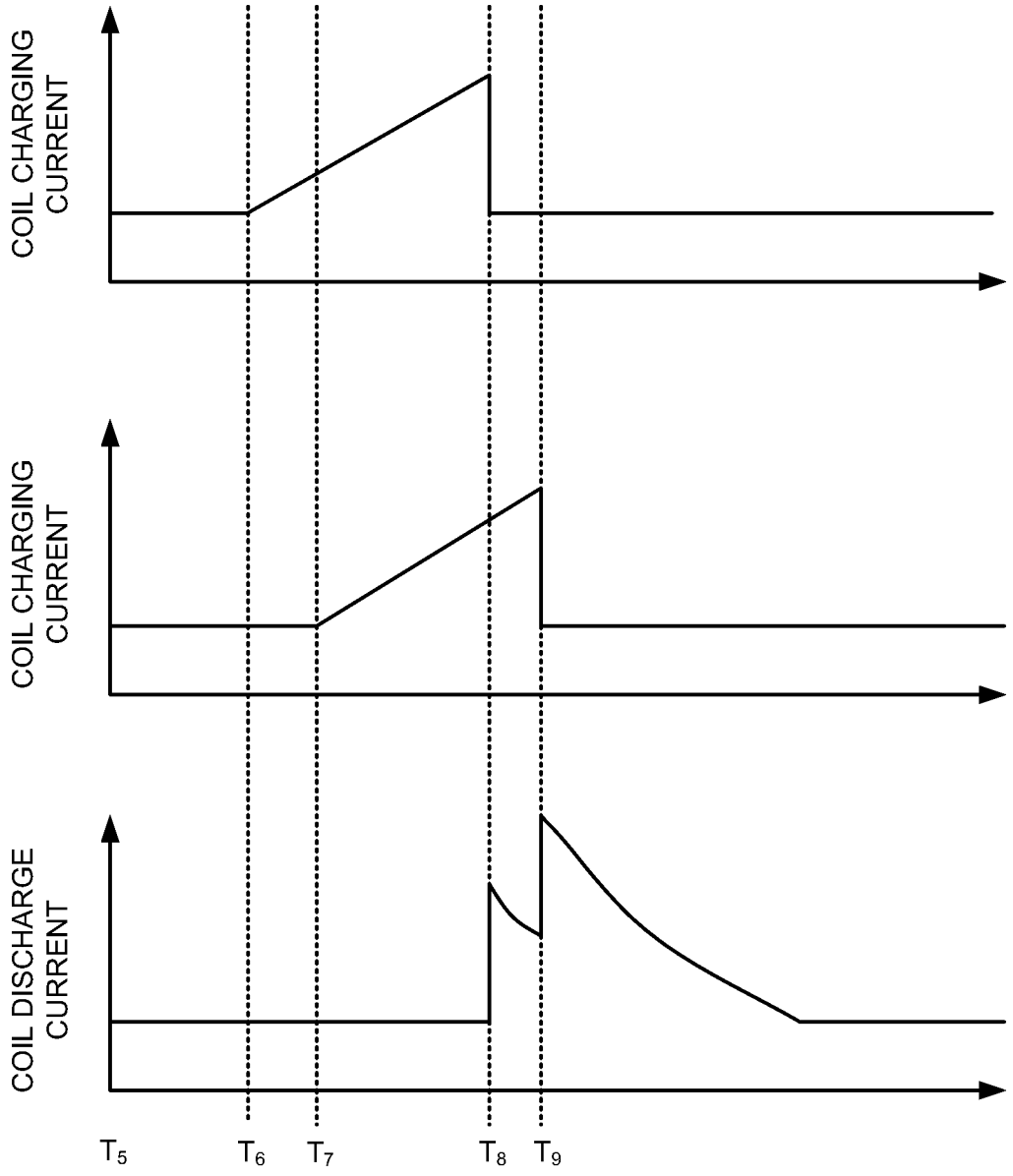
FIG. 6 shows example signals of two ignition coils supplying electrical energy to a spark plug.
Figure 7:
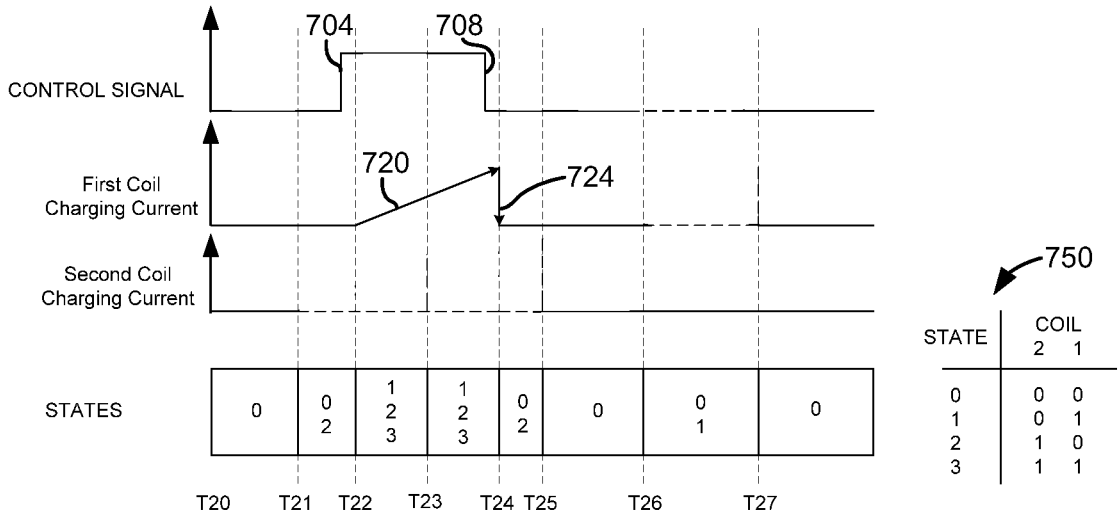
FIG. 7 shows example control signals for a first ignition system.
Figure 8:
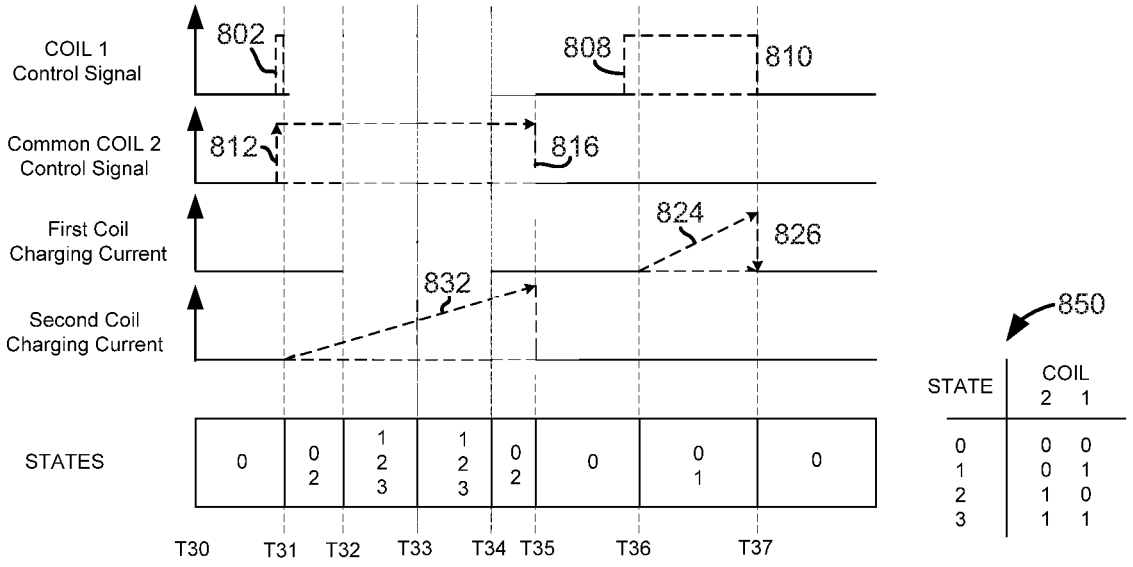
FIG. 8 shows example control signals for an alternative second alternative ignition system.
Figure 9:
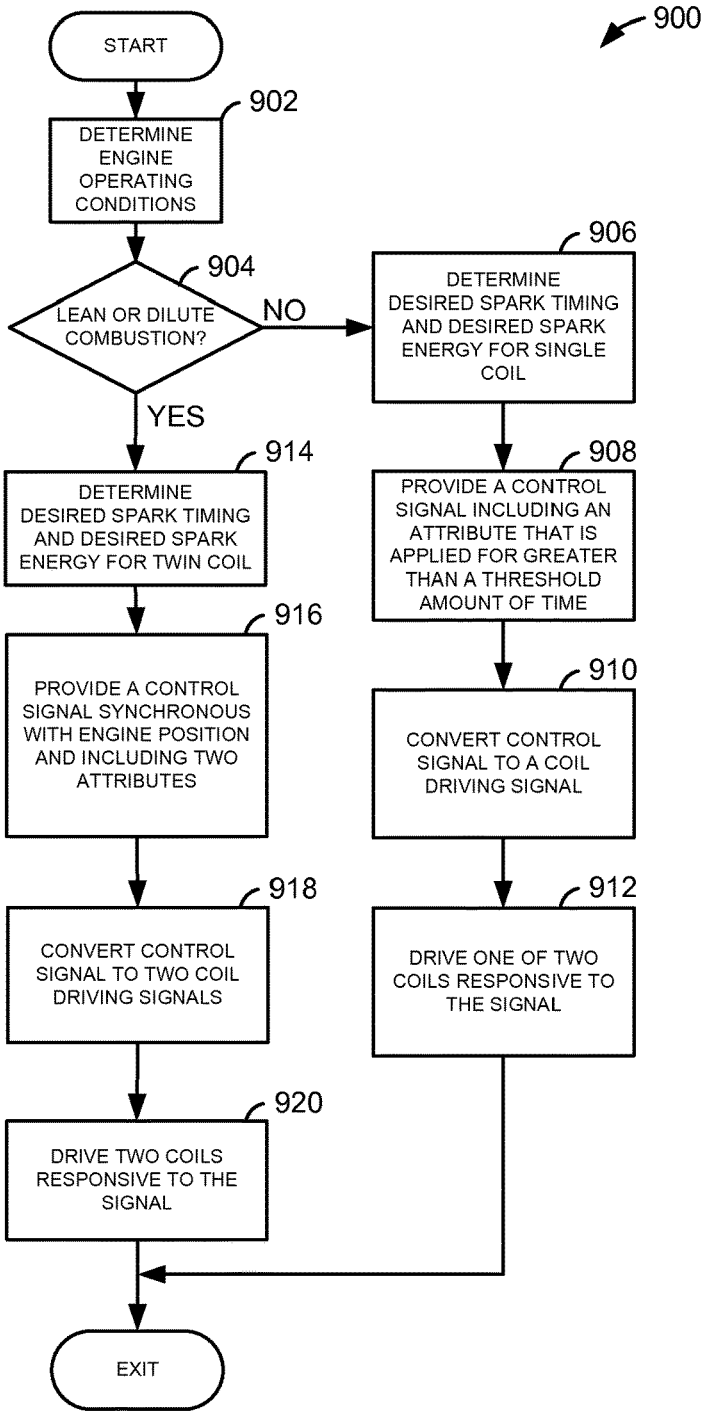
FIG. 9 is a flow chart of an example method for supplying electrical energy to a spark plug.

The present description is related to supplying energy to a spark ignition engine spark plug. In one non-limiting example, a control signal is supplied over a single wire. Two coils may be individually operated at different times in response to the control signal. Thus, instead of two wires supplying control signals to two ignition coils, a single wire may be utilized to perform the same function. In this way, a number of controller outputs may be reduced. Further, fewer wires may be used within the system as compared to other multiple coil systems. FIGS. 1, 3, and 4 show example ignition systems. FIG. 2 shows a prior art ignition system. The systems of FIGS. 1, 3, and 4 may provide spark energy as is shown in FIGS. 5 and 6. Example ignition system control signals are shown in FIGS. 7 and 8. Finally, FIG. 9 shows an example method for supplying energy to a single spark plug via two ignition coils.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of adjustable intake cam 51 may be determined by intake cam sensor 55. The position of adjustable exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In one aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example the engine may be turbocharged or supercharged.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a schematic of an example prior art ignition system. In this example, controller 12 includes two ignition coil pre-driver circuits 280 and 282, one for each ignition coil that may be operated to supply electrical energy to a spark plug of a single cylinder. The two ignition coil pre-driver circuits 280 and 282 supply low level current to ignition coil drivers 202 and 204. Ignition coil drivers 202 and 204 are included in ignition system 88 which may be positioned on top of or near spark plug 92. First ignition coil pre-driver circuit 280 may supply a signal to first ignition coil driver 202. First ignition coil 206 is selectively supplied current via first coil driver 202. Electric energy storage device 220 sources electrical current to first ignition coil 206. Similarly, second ignition coil pre-driver circuit 282 may supply a signal to second ignition coil driver 204. Second ignition coil 208 is selectively supplied current via second coil driver 204. Electric energy storage device 220 sources electrical current to second ignition coil 208.

Spark plug 92 may be supplied electrical energy from first ignition coil 206 and/or second ignition coil 208. Spark plug 92 includes a first electrode 260 and a second electrode 262. Second electrode 262 may be in continuous electrical communication with ground 240. A spark may develop across gap 250 when an electrical potential difference exists between first electrode 260 and second electrode 262.

The system of FIG. 2 requires two different signals and two separate wires or conductors 241 and 242 to operate first ignition coil 206 and second ignition coil 208. Further, the ignition system shown in FIG. 2 shows a system for a single cylinder engine. For each additional engine cylinder beyond the one shown, every element of FIG. 2 has to be provided, excepting energy storage device 220 and ground 240. Thus, the system of FIG. 2 requires a pre-driver circuit and wire for every second coil, thereby doubling the wiring of a single ignition coil per spark plug ignition system.

Referring now to FIG. 3, an example of a first alternative ignition system is shown. The ignition system of FIG. 3 includes some of the same elements as shown in the system of FIG. 2. The elements of FIG. 3 that are the same as those shown in FIG. 2 have the same numbers as the elements shown and described in FIG. 2.

In this system, controller 12 includes a sole ignition pre-driver circuit for supplying a control signal to first ignition coil 206 and second ignition coil 208. Where the engine includes N cylinders, N ignition coil pre-driver circuits provide control signals for ignition coils. The output of pre-driver circuit 280 is directed to interpretive logic 302. Interpretive logic 302 may be included in a programmable logic array, as part of logic programmed into a central processing unit or an application specific integrated circuit (ASIC). Interpretive logic 302 monitors the timing and level of a signal provided by pre-driver circuit 280. In one non-limiting example, the timing of the signal provided by pre-driver circuit 280 may be as described in FIG. 7. For example, interpretive logic 302 changes a state of a signal supplied to ignition coil driver 202 when a pulse width of the control signal is longer than a first predetermined time. Interpretive logic changes a state of a signal supplied to ignition coil driver 204 when a pulse width of the control signal is less than a second predetermined time. Interpretive logic 302 may output individual signals to ignition coil drivers 202 and 204. The signals supplied to ignition coil drivers 202 and 204 by interpretive logic 302 are synchronous with cylinder strokes of the cylinder being supplied spark via first ignition coil 206 and second ignition coil 208. In one example, at least one spark is provided during each cycle of the cylinder receiving spark from first ignition coil 206 and/or second ignition coil 208. For example, a spark may be supplied once a cylinder cycle during a compression stoke of the cylinder receiving spark. Further, in one example, first ignition coil 206 has a different inductance than second ignition coil 208.

Referring now to FIG. 4, an example of a second alternative ignition system is shown. The ignition system of FIG. 4 includes some of the same elements as shown in the system of FIG. 2. The elements of FIG. 4 that are the same as those shown in FIG. 2 have the same numbers as the elements shown and described in FIG. 2.

Similar to the system of FIG. 2, FIG. 4 shows a controller with a first pre-driver circuit 280 and a second pre-driver circuit 282. FIG. 4 differs from the system of FIG. 2 in that the system of FIG. 4 includes interpretive logic 402. Additionally, second pre-driver circuit 282 not only supplies a coil control signal to interpretive logic 402, which serves to operate second ignition coil 208, but pre-driver circuit 282 also supplies signals to interpretive logic of cylinders N through the total number of engine cylinders as indicated at 403-405. Conductor 441 carries a signal indicative of when to charge and discharge first ignition coil 206. Conductor 442 carries a signal indicative of when to charge and discharge second ignition coil 208 as well as second ignition coils of each of the other engine cylinders as represented by 411-413. In this way, only one extra wire 442 from controller 12 is provided to drive the second ignition coils 411-413 for each engine cylinder. A signal for driving each of the second ignition coils from the other engine cylinders is provided by second pre-driver circuit 282 and conductor 442.

In this example, interpretive logic 402 provides control signals to first ignition coil driver circuit 202 and second ignition coil driver circuit 204. Interpretive logic 402 provides a control signal to second ignition coil driver circuit 204 by selecting one pulse from a plurality of pulses during an engine cycle as the basis for operating second ignition coil driver circuit 204. The first ignition coils (not shown) of each of the engine's other cylinders are supplied a control signal from pre-driver circuits similar to 280.

Thus, the systems of FIGS. 1, 3, and 4 provide for supplying spark to an engine, comprising: a first ignition coil pre-driver circuit; interpretive logic that is in electrical communication with the first ignition coil pre-driver circuit, the interpretive logic including two ignition coil driver outputs; and two ignition coil driver circuits in electrical communication with the interpretive logic. The system further comprises two ignition coils that are in electrical communication with the two ignition coil driver circuits. The system further comprises a second ignition coil pre-driver circuit that is in electrical communication with the interpretive logic. The system includes where the second ignition coil pre-driver circuit is in electrical communication with interpretive logic for a plurality of engine cylinders. The system includes where the first ignition coil pre-driver circuit is in electrical communication with only one ignition coil driver circuit of a plurality of ignition coil driver circuits.

Referring now to FIG. 5, example signals of a sole ignition coil supplying electrical energy to a spark plug are shown. The signals may be provided by the system shown in FIG. 3 or FIG. 4. When solely first ignition coil 206 or second ignition coil 208 provides energy for a spark during a cylinder cycle, the other of the ignition coils does not receive a signal to charge or discharge. Vertical markers $T_0$-$T_2$ represent times of interest during the sequence.

The first plot from the top of FIG. 5 represents an ignition coil charging current versus time for first ignition coil 206 or second ignition coil 208. The Y axis represents ignition coil charging current and ignition coil charging current increases in the direction of the Y axis arrow. The X axis represents time and time increases in the direction of the X axis arrow.

The second plot from the top of FIG. 5 represents an ignition coil discharge current versus time for first ignition coil 206 or second ignition coil 208. The Y axis represents ignition coil discharge current and ignition coil discharge current increases in the direction of the Y axis arrow. The X axis represents time and time increases in the direction of the X axis arrow.

At time $T_0$, the ignition coil is neither charging nor discharging. An ignition coil may not be charging or discharging during an intake or exhaust stroke of the cylinder receiving the spark, for example.

At time $T_1$, current begins to flow into the ignition coil at a primary side in response to a desired spark timing based on engine speed and load. Current may flow into the ignition coil when a switch or driver is closed to permit current to flow from an energy source to the ignition coil. In one example, ignition coil driver 202 closes after receiving a command from interpretive logic 302 shown in FIG. 3. In another example, ignition coil driver 202 closes after receiving a command from interpretive logic 402 shown in FIG. 4.

At time $T_2$, current flow to the primary side of the ignition ceases in response to the desired spark timing causing the secondary side of the ignition coil to discharge and induce current flow between the ignition coil and the spark plug. The ignition coil current decays as time increases. In one example, ignition coil driver 202 opens at time $T_2$ in response to the command from interpretive logic 302 shown in FIG. 3. In another example, ignition coil driver 202 opens at time $T_2$ in response to the command from interpretive logic 402 shown in FIG. 4.

Thus, FIG. 5 shows example ignition coil signals for the circuits of FIGS. 3 and 4 when a single ignition coil is operated in the circuits. Such operation may be similar to operation of an ignition coil in a single coil per spark plug ignition system.

Referring now to FIG. 6, example signals for two ignition coil supplying electrical energy to a spark plug are shown. The signals may be provided by the system shown in FIG. 3 or FIG. 4. FIG. 6 shows first ignition coil 206 and second ignition coil 208 provide energy for a spark during a cylinder cycle. Vertical markers $T_5$-$T_9$ represent times of interest during the sequence.

The first plot from the top of FIG. 6 represents an ignition coil charging current for a first ignition coil supplying electrical energy to a spark plug versus time. First ignition coil may be ignition coil 206 show in FIGS. 3 and 4. The Y axis represents ignition coil charging current and ignition coil charging current increases in the direction of the Y axis arrow. The X axis represents time and time increases in the direction of the X axis arrow.

The second plot from the top of FIG. 6 represents an ignition coil charging current for a second ignition coil supplying electrical energy to a spark plug versus time. Second ignition coil may be ignition coil 208 show in FIGS. 3 and 4. The Y axis represents ignition coil charging current and ignition coil charging current increases in the direction of the Y axis arrow. The X axis represents time and time increases in the direction of the X axis arrow.

The third plot from the top of FIG. 6 represents an ignition coil discharge current from the first and second ignition coils versus time. The Y axis represents ignition coil discharge current and ignition coil discharge current increases in the direction of the Y axis arrow. The X axis represents time and time increases in the direction of the X axis arrow.

At time $T_5$, the ignition coils are neither charging nor discharging. An ignition coil may not be charging or discharging during an intake or exhaust stroke of the cylinder receiving the spark, for example.

At time $T_6$, current begins to flow into the first ignition coil at a primary side in response to a desired spark timing that is based on engine speed, load, and engine dilution. Current may flow into the first ignition coil when a switch or driver is closed to permit current to flow from an energy source to the first ignition coil. In one example, ignition coil driver 202 closes after receiving a command from interpretive logic 302 shown in FIG. 3. In another example, ignition coil driver 202 closes after receiving a command from interpretive logic 402 shown in FIG. 4.

At time $T_7$, current begins to flow into the second ignition coil at a primary side in response to a desired spark timing that is based on engine speed, load, and intake charge mixture dilution. Current may flow into the second ignition coil when a switch or driver is closed to permit current to flow from an energy source to the first ignition coil. In one example, ignition coil driver 204 closes after receiving a command from interpretive logic 302 shown in FIG. 3. In another example, ignition coil driver 204 closes after receiving a command from interpretive logic 402 shown in FIG. 4.

At time $T_8$, current flow to the primary side of the first ignition ceases in response to the desired spark timing causing the secondary side of the first ignition coil to discharge and induce current flow between the ignition coil and the spark plug. The first ignition coil current decays as time increases. In one example, ignition coil driver 202 opens at time $T_8$ in response to the command from interpretive logic 302 shown in FIG. 3. In another example, ignition coil driver 202 opens at time $T_8$ in response to the command from interpretive logic 402 shown in FIG. 4.

At time $T_9$, current flow to the primary side of the second ignition ceases in response to the desire spark timing causing the secondary side of the second ignition coil to discharge and induce current flow between the ignition coil and the spark plug. The second ignition coil current bolsters current from the first ignition coil extending spark duration and spark energy. In one example, ignition coil driver 204 opens at time $T_9$ in response to the command from interpretive logic 302 shown in FIG. 3. In another example, ignition coil driver 204 opens at time $T_9$ in response to the command from interpretive logic 402 shown in FIG. 4.

Thus, FIG. 6 shows example ignition coil signals for the circuits of FIGS. 3 and 4 when two ignition coils are operated in the circuits. In this way, spark duration and energy may be increased so as to improve combustion stability in cylinders that are operating lean or diluted.

Referring now to FIG. 7, a figure showing control signals for an ignition system that includes two ignition coils (e.g., the system of FIG. 3) during a single cylinder cycle. The signals represent signals that control two coils that provide spark to a single cylinder (e.g., cylinder number one). The signals shown are for a portion of an engine cycle and similar control signals are output for each cylinder cycle. Signals for other engine cylinders similar to those shown are also provided via the single ignition control signal at different times during an engine cycle (e.g., during a compression stroke of each cylinder of the engine). The signals of FIG. 7 may be produced by the system of FIGS. 1 and 3 according to the method of FIG. 9. Vertical markers $T_{20}$-$T_{27}$ represent times of particular interest during the sequence.

The first plot from the top of FIG. 7 shows a single ignition coil control signal that is the basis for operating the first and second ignition coils supplying electrical energy to a single spark plug. The ignition coil control signal changes state in response to engine speed, engine load, engine combustion mode (e.g., lean or dilute) among other variables. The solid portion of the ignition control signal trace, at 704 for example, shows one example ignition coil control signal for operating a single ignition coil during a cylinder cycle.

The second plot from the top of FIG. 7 shows a first ignition coil charging current. The charging current flows into a primary coil in the first ignition coil. A dwell time is an amount of time that charging current flows into the ignition coil. Electrical energy is being stored in the first ignition coil of two ignition coils supplying energy to a spark plug when charging current flows into the first ignition coil. The amount of energy stored in the first ignition coil increases as the charging current moves in the direction of the Y axis arrow. The first ignition coil is not charging when the first charging current is at a lower level near the X axis. A solid line, such as at 720, represents a first coil charging current when the coil control signal in the first plot from the top of FIG. 7 is at the timing of a solid line, such as at 704, for example.

The third plot from the top of FIG. 7 shows a second ignition coil charging current. The second ignition coil of the two ignition coils supplying energy to the lone spark plug is charging when the second coil charging current is increasing. The second ignition coil is increasing when the second ignition coil charging current signal is increasing in the direction of the Y axis arrow. The second ignition coil is not charging when the second ignition coil charging current signal is at a lower level near the X axis.

The fourth plot from the top of FIG. 7 represents potential operating states for the first and second ignition coils. The operating states correspond to operation of the first and second ignition coils according to the state table 750. For example, in state number two, only the second ignition coil is being charged. In state number three, both the first and second ignition coils are being charged.

At time $T_{20}$, the first ignition coil charging current and the second ignition coil charging current are at a low level indicating that the first and second ignition coils are not being charged. The ignition coil state is also at a value of zero indicating that the first and second ignition coils are not being charged. The ignition coil control signal is also at a low level indicating that the coils are not being commanded to charge.

Between time $T_{20}$ and time $T_{21}$, a short duration pulse may be provided. In one example, when the high level duration of a pulse of the ignition coil control signal is less than a predetermined threshold (e.g., less than 75 μs), the ignition coil control signal commands the second ignition coil charging current to increase so as to charge the second ignition coil at time $T_{21}$. The short duration ignition coil control signal is converted to a second ignition coil charging current via interpretive logic as is shown at 302 in FIG. 3. The second ignition coil charging current increases a predetermined amount of time after the ignition coil control signal transitions to a low level after being at a high level for less than a predetermined amount of time. The ignition coil states change from zero to zero and two at time $T_{21}$. The second ignition coil also may increase to provide a longer duration of ignition coil charging. Thus, if the ignition coil control signal includes a pulse, the ignition coil state is a value of two indicating that only the second ignition coil may be active during the time between time $T_{21}$ and time $T_{22}$.

Shortly before time $T_{22}$, the ignition coil control signal transitions to a high level and stays at the high level at 704 for longer than a predetermined amount of time (e.g., more than 150 μs) indicating to turn the first ignition coil on by charging the first ignition coil as shown at 720. A predetermined amount of time after the ignition coil control signal transitions to a higher level at 704, the first ignition coil charge current begins to increase to a higher level at time $T_{22}$ indicating that the first ignition coil is charging. The delay time between 704 and time $T_{22}$ allows the interpretive logic to determine whether the first or second ignition coil should be charging. The possible ignition coil states are indicated as one, two, and three. If only a longer duration pulse is provided by the ignition coil control signal, only ignition coil one is operated. If a longer duration pulse is not provided and if a shorter duration pulse is provided by the ignition coil control signal, only the second ignition coil is operated. If both longer and shorter pulse durations are provided by the ignition coil control signal, both the first and second ignition coils are operated. A short duration control signal pulse, whether transitioning from a low level to a high level, or vice versa, operates to change the state of the second ignition coil charging current. In this way, the ignition coil control signal outputs a single signal that may be interpreted as instructions for two ignition coil dwell or ignition coil charging signals. Further, it should be mentioned that if a short pulse width is provided, the second ignition coil begins to charge before the first ignition coil begins to charge. A short pulse serves to command the second ignition coil. In this way, ignition coil 2 can be discharged before ignition coil 1 and the timing between ignition coil charging and discharging may be varied.

At 708, the ignition coil control signal transitions to a low state indicating that the first ignition coil is commanded to stop charging. The first ignition coil charging current transitions to a low state at 724 and time $T_{24}$. The available ignition coil states between time $T_{23}$ and time $T_{24}$ are based on the combination of possible ignition coil pulses is indicated as one, two, and three.

The ignition coil control signal may briefly transition to a higher state to indicate that the second ignition coil is to stop receiving charge via the second charging current. The possible ignition coil states between time $T_{24}$ and time $T_{25}$ are indicated at being zero and two. It should also be mentioned that the timing be adjusted to vary the end of charging the second ignition coil relative to end of charging of the first ignition coil.

The ignition control signal may transition to a high state to indicate that the first ignition coil is to be charged a second time during the cylinder cycle. The possible ignition coil state between time $T_{25}$ and time $T_{26}$ is state zero.

The predetermined amounts of time after a transition of the ignition coil control signal allows the interpretive logic to determine whether the first ignition charging current or the second ignition charging current should change state.

Thus, the ignition control signal is a single signal that may provide shorter duration signal level changes to encode state changes for a second ignition coil charging current, while the same signal provides longer duration signal levels to encode state changes for a first ignition coil charging current. Holding the ignition coil control state for a predetermined amount of time is a basis for allowing the interpretive logic to determine charging current of a selected ignition coil to be adjusted.

Because the second ignition coil's state is locally controlled by memory in the interpretive logic, 302 of FIG. 3 (note that the short duration pulse from the controller, 12, is a toggling function), special precautions may be taken to avoid loss of sync with the desired state in the controller. These precautions may include an over dwell protection that resets the second ignition coil to the off state. The precautions may include but are not necessarily limited to: a power-on reset (resets upon application of power to the ignition assembly), over current reset (resets upon sensing the second ignition coil's primary current over a predetermined limit), and over ignition dwell time reset (resets upon determining that ignition coil 2 has been turned on over a predetermined amount of time).

Referring now to FIG. 8, example control signals for an alternative second ignition system are shown (e.g., the system of FIG. 4). The signals represent signals to control two coils providing spark to a single cylinder (e.g., cylinder number one). Signals for other engine cylinders (not shown) are similar to those shown. Further, signals for other engine cylinders are provided via a $N^{th}$ ignition coil signal and the common ignition control signal. The signals for other engine cylinders are provided at different times during an engine cycle as compared to the signals shown in FIG. 8. The signals of FIG. 8 may be produced by the system of FIGS. 1 and 4 according to the method of FIG. 9 and are representative for a single cylinder cycle. Vertical markers $T_{30}$-$T_{37}$ represent times of particular interest during the sequence.

The first plot from the top of FIG. 8 shows one of two ignition coil control signals that are the basis for operating the first and second ignition coils supplying electrical energy to a single spark plug. The ignition coil control signals change state in response to engine speed, engine load, engine combustion mode (e.g., lean or dilute) among other variables. The dashed portion of the trace, at 808 for example, shows the ignition coil control signal for providing multiple sparks during the cylinder cycle.

The second plot from the top of FIG. 8 shows a second of two ignition coil control signals that is the basis for operating the second ignition coil supplying electrical energy to a single spark plug. The second ignition coil control signal changes state in response to engine speed, engine load, engine combustion mode (e.g., lean or dilute) among other variables. The dashed signal (e.g., 812-816) shows when the control signal for the second coil may transition from a low state to a high state or vice-versa. Additionally, the second ignition coil control signal is carried on a conductor that is routed to each second ignition coil of each engine cylinder.

The third plot from the top of FIG. 8 shows a first ignition coil charging current. A first ignition coil of two ignition coils supplying energy to a spark plug is charging when the first ignition coil charging current is increasing. The first ignition coil is increasing when the first ignition coil charging current move in the direction of the Y axis arrow. The first ignition coil is not charging when the first ignition coil charging current near the X axis. A dashed line, such as at 824, represents a first ignition coil charging current produced when the coil control signal in the first plot from the top of FIG. 8 is at a timing of a dashed line, such as at 808, for example.

The fourth plot from the top of FIG. 8 shows a second ignition coil charging current. The second ignition coil of the two ignition coils supplying energy to the lone spark plug is charging when the second ignition coil charging current is increasing. The second ignition coil is increasing when the second ignition coil charging current is increasing in the direction of the Y axis arrow. The second ignition coil is not charging when the second ignition coil charging current is at a lower level near the X axis. The dashed line 832 represents ignition coil charging current signal timings that may provided by the control signal in the second plot from the top of FIG. 8.

The fifth plot from the top of FIG. 8 represents potential operating states for the first and second ignition coils. The operating states correspond to operation of the first and second ignition coils according to the state table 850. For example, in state number two, only the second ignition coil is being charged. In state number three, both the first and second ignition coils are being charged.

At time $T_{30}$, the first ignition coil charging current and the second ignition coil charging current are at a low level indicating that the first and second ignition coils are not being charged. The ignition coil state is also at a value of zero indicating that the first and second ignition coils are not being charged. The ignition coil control signals are also at a low level indicating that the coils are not being commanded to charge.

Just before time $T_{31}$, the common second ignition coil control signal is shown transitioning to a higher level at 812 and the first ignition coil control signal is shown transitioning to a higher level at 802 for a threshold amount of time (e.g., greater than 75 μs). When both the first ignition coil control signal and the second ignition control signal are at a higher level for a threshold amount of time the second ignition coil charging current begins to increase. A predetermined amount of time after both coil control signals are high, the second ignition coil charge current begins to increase at 830 in response to the transitions at 802 and 812. The ignition coil states change from zero to zero and two at time $T_{31}$. Thus, if the ignition coil control signals include pulses as shown at 802 and 812, the ignition coil state is a value of two indicating that only the second ignition coil may be active during the time between time $T_{31}$ and time $T_{32}$.

The available ignition coil states between time $T_{33}$ and time $T_{34}$ are based on the combination of possible ignition coil pulses and are indicated as one, two, and three.

At 816, the second ignition control signal is shown transitioning to a lower level from a higher level in response to the desired engine spark timing. The second ignition coil charging current also transitions from a higher level to a lower level at time $T_{35}$ in response to the second ignition coil control signal. The second ignition coil dwell signal indicates that the second ignition coil is no longer charging. The possible ignition coil state between time $T_{35}$ and time $T_{36}$ is state zero.

At 808, the first ignition coil control signal is shown transitioning to a higher level in response to the desired engine spark timing. A predetermined amount of time later at time $T_{36}$, the first ignition coil charging current is increased to a higher level at 824. In this way, the charging current signal of the first ignition coil may be adjusted to a higher level so as to provide energy for a second spark at the spark plug. Between time $T_{36}$ and time $T_{37}$, the ignition coils may be in state zero or state one.

At 810, the first ignition coil signal transitions to a lower level to indicate that first ignition coil charging is to be ceased. The first ignition coil charging current signal is transitioned to a lower level shortly thereafter at 826 and at time $T_{37}$. The ignition coil states are at a value of zero after time $T_{37}$.

Thus, two ignition control signals control two ignition coils of a single cylinder. Further, one of the two ignition control signals is routed to other engine cylinders so as to control the second coils of the engine's remaining cylinders. Further, the timings illustrated in FIGS. 7 and 8 are merely for illustration purposes and are not to be considered as limiting the scope or breadth of the description.

It should also be noted that the first ignition coil may be discharged by ceasing current flow to the first ignition coil after the first ignition coil begins to charge. Likewise, the second ignition coil may be discharged by ceasing current flow to the second ignition coil after the second ignition coil begins to charge. Thus, charging and discharging of the respective ignition coils is controlled via current supplied to the ignition coils.

Referring now to FIG. 9, a method for supplying electrical energy to a spark plug is shown. The method of FIG. 9 may be stored in non-transitory memory of controller 12 shown in FIG. 1 as executable instructions. Further, the method of FIG. 9 may be applied to the systems of FIGS. 1, 3, and 4 to provide the sequences in FIGS. 5-8.

At 902, method 900 determines engine operating conditions. Engine operating conditions may include but are not limited to engine speed, engine load, engine air-fuel ratio, engine EGR amount, and time since engine start. Method 900 proceeds to 904 after engine operating conditions are determined.

At 904, method 900 judges whether or not the engine is operating in a lean or dilute mode. In one example, method 900 judges the engine is operating in a lean mode based on an engine air-fuel ratio. In another example, method 900 judges the engine is operating in dilute conditions when engine EGR amount is greater than a threshold amount. If method 900 judges that the engine is operating lean or dilute, method 900 proceeds to 914. Otherwise, method 900 proceeds to 906. If the engine is not operating lean or dilute, only energy from a single ignition coil may be supplied to a spark plug during a cylinder cycle. If the engine is operating lean or dilute, energy from two ignition coils may be supplied to the spark plug during the cylinder cycle.

At 906, method 900 determines a desired spark timing and spark energy to deliver to a single spark plug of an engine cylinder. In one example, engine spark advance is empirically determined and stored in a table that is indexed via engine speed and load. Desired spark is output from the table and modified based on one or more functions that modify spark advance in response to engine EGR amount and/or engine air-fuel ratio. Similarly, a spark dwell time that corresponds to an amount of desired spark energy in joules is determined based on engine speed and load. The spark energy is modified via adjusting ignition coil dwell time. Method 900 proceeds to 908 after desired spark timing and energy are determined.

At 908, method 900 adjusts at least one spark control signal attribute based on the desired spark timing and energy. In one example, the spark control signal attribute may be a crankshaft angle at which a spark dwell command is sent to an ignition coil. Further, method 900 may adjust ignition command pulse duration.

In one example, method 900 adjusts a spark attribute supplied to a single conductor that carries a command signal referenced to ground, where the command signal includes spark timing and dwell information for each group of two ignition coils that provide energy to a single spark plug. A single conductor may be supplied for each engine cylinder. The single attribute may include supplying a pulse width of a signal including a duration that is less than a predetermined amount of time as is shown in FIG. 7. Alternatively, the single attribute may be to supply a pulse width of a signal including a duration that is greater than a predetermined amount of time as is shown in FIG. 7. The duration of the pulse width may be a basis for supplying an amount of charge to one of two ignition coils. The timing of the pulse width may be a basis for starting and/or ending ignition coil charging. The pulse width may be for a high or a low level portion of a signal. In one example where the pulse width is greater than a predetermined amount of time, a first of two ignition coils is charged or discharged in reference to a timing of a control signal pulse width that is relative to engine position.

In another example, method 900 adjusts one attribute from either of two signals that may be supplied via two conductors referenced to ground. The two signals may be provided during a cylinder cycle and include spark timing information for supplying spark to a cylinder via a single spark plug that may be supplied energy via two ignition coils. The adjusted attribute may be a timing that one of the two control signals is in a high state or a low state relative to engine position. By adjusting pulse width timing of one signal, it is possible to adjust spark timing and energy delivered via a single ignition coil to a single spark plug. It should also be mentioned that one of the two signals carries information for spark timing of all engine cylinders while the other of the two signals carries information for spark timing of one engine cylinder. An example of adjusting spark provided via a single ignition coil of a system that is capable of supplying energy from two ignition coils to a single spark plug is shown in FIG. 8. Method 900 proceeds to 910 after an attribute of a control signal is adjusted.

At 910, method 900 converts a control signal to a coil driving signal. The coil driving signal determines when charging and discharging of a single coil of two coils that may supply energy to a single spark plug occurs.

In one example where control of charging two ignition coils supplying energy to a single spark plug is directed via a single command signal, method 900 interprets the single command signal and outputs a dwell signal to a single ignition coil of the two ignition coils.

In another example where control of charging two ignition coils supplying energy to two spark plugs is directed via two control signals, method 900 interprets one of the two control signals and outputs a dwell signal to a single ignition coil of the two ignition coils. Method 900 proceeds to 912 after outputting the dwell signal.

At 912, method drives one of two ignition coils with current. The ignition coil charges when the dwell signal allows current flow to the ignition coil. The ignition coil is discharged when current flow to the ignition coil ceases. In one example, the ignition coils may be supplied current via a field effect transistor or another type of switching device. Method 900 proceeds to exit after one of two ignition coils supplies energy to a spark plug.

At 914, method 900 determines a desired spark timing and spark energy to deliver to a single spark plug of an engine cylinder via two ignition coils. In one example, engine spark timing is empirically determined and stored in two tables that are indexed via engine speed and load. Desired timing for supplying energy to the spark plug is output from the table and modified based on one or more functions that modify ignition coil charging and discharge timing in response to engine EGR amount and/or engine air-fuel ratio. Similarly, a spark dwell time for each ignition coil that corresponds to an amount of desired spark energy in joules is determined based on engine speed and load. The spark energy is modified via adjusting ignition coil dwell time. Method 900 proceeds to 916 after desired spark timing and energy are determined.

At 916, method 900 adjusts at least two spark control signal attributes based on the desired spark timing and energy. In one example, the spark control signal attributes may be crankshaft angles at which two spark dwell commands are supplied to the two ignition coils. Thus, the dwell commands are output synchronous with engine position for each cylinder cycle. Further, method 900 may adjust the ignition command pulse durations that are supplied to the two ignition coils.

In one example, method 900 adjusts two spark attributes supplied via a single conductor that carries a command signal referenced to ground, where the command signal includes spark control instructions for a plurality of cylinders, where the command signal includes spark timing and dwell information for each group of two ignition coils that provide energy to a single spark plug, and where the command signal includes spark timing and dwell information for each spark plug in each of the plurality of cylinders. The two attributes may include a first attribute of supplying a pulse width within the command signal including a duration that is less than a predetermined amount of time as is shown in FIG. 7. The second attribute may include supplying a pulse width within the command signal including a duration that is greater than a predetermined amount of time as is shown in FIG. 7. In this way, two different pulse widths may indicate desired ignition coil commands via a single conductor that carries the command signal. The duration of a first pulse width may be a basis for supplying an amount of charge supplied to a first ignition coil. The duration of a second pulse width may be a basis for supplying an amount of charge supplied to a second ignition coil. The timing of the pulse widths may be a basis for starting and/or ending ignition coil charging. The pulse widths may be for a high or a low level portion of a signal. In one example when a pulse width is greater than a predetermined amount of time, a first of two ignition coils is charged or discharged referenced to a timing of a control signal pulse width that is relative to engine position. In another example when a pulse width is less than a predetermined amount of time, a second of two ignition coils is charged or discharged referenced to a timing of a control signal pulse width that is relative to engine position.

In another example, method 900 adjusts two attributes of two ignition coil command signals that may be supplied via two conductors referenced to ground. The two signals may be provided during a cylinder cycle and include spark timing information for supplying spark to a cylinder via a single spark plug that may be supplied energy via two ignition coils. The adjusted attributes may include a timing that one of the two control signals is in a high state or a low state relative to engine position. The other attribute may include a timing that the other of the two control signals is in a high state for in a low state relative to engine position. By adjusting pulse width timing of two signals supplied via two conductors, it is possible to adjust spark timing and energy delivered via two ignition coils to a single spark plug. It should also be mentioned that one of the two signals carries information for spark timing of all engine cylinders while the other of the two signals carries information for spark timing of one engine cylinder. An example of adjusting spark provided to a single spark plug via two ignition coils is shown in FIG. 8. Method 900 proceeds to 918 after two attributes of two control signals are adjusted.

At 918, method 900 converts one or more control signals to a coil driving signal. The coil driving signal determines when charging and discharging of two ignition coils that may supply energy to a single spark plug occurs.

In one example where control of charging two ignition coils supplying energy to a single spark plug is directed via a single command signal, method 900 interprets the single command signal and outputs dwell signals to two ignition coils. The dwell signals are output each cylinder cycle. Further, multiple circuits and ignition coils supply energy to spark plugs in each engine cylinder. Pulse widths that are less than a predetermined amount of time are the basis for supplying current to one of two ignition coils. Pulse widths that are greater than a predetermined amount of time are the basis for supplying current to the other of the two ignition coils.

In another example where control of charging two ignition coils supplying energy to two spark plugs is directed via two control signals and two conductors, method 900 interprets both of the two control signals and outputs two dwell signals to the two ignition coils supplying spark energy to a single spark plug. Method 900 proceeds to 1920 after outputting the two dwell signals.

At 920, method drives two ignition coils with current. The ignition coils charge when the dwell signals allow current flow to the ignition coils. The ignition coils are discharged when current flow to the ignition coils cease. In one example, the ignition coils may be supplied current via a field effect transistor or another type of switching device. Method 900 proceeds to exit after the two ignition coils supply energy to a spark plug.

In this way, method 900 may supply a dwell signal to a single ignition coil of a system that may supply energy to a spark plug via two ignition coils. Further, method 900 may supply two dwell signals based on two dwell control signals, one of which includes ignition timing for other engine cylinders.

Thus, the method of FIG. 9 provides for delivering spark to an engine, comprising: supplying two different ignition coil dwell times via a single conductor, the two different dwell times supplied to a first ignition coil and a second ignition coil; and discharging the first ignition coil and the second ignition coil to a single spark plug. The method further comprises converting the two different ignition coil dwell times into two ignition coil commands. The method further comprises operating two ignition coil drivers in response to the two ignition coil commands. The method includes where a first dwell time is provided to the first ignition coil and where a second dwell time is provided to the second ignition coil.

Additionally, the method further comprised supplying the first dwell time at a first engine crankshaft angle and supplying the second dwell time at a second engine crankshaft angle. The method includes where the first engine crankshaft angle is retarded from the second engine crankshaft angle. The method includes where the first engine crankshaft angle is advanced from the second engine crankshaft angle.

In another example, the method of FIG. 9 provides for delivering spark to an engine, comprising: supplying a first ignition coil dwell time to a first ignition coil via a first conductor; supplying a second ignition coil dwell time to a second ignition coil via a second conductor; and discharging the first ignition coil and the second ignition coil to a single spark plug. The method includes where the first ignition coil dwell time is provided via a first pulse width that is greater than a first threshold time.

In some examples, the method includes where the second ignition coil dwell time is provided via a second pulse width that is less than a second threshold time. The method includes where the second conductor also carries ignition coil dwell times for a plurality of engine ignition coils. The method includes where first ignition coil dwell time and the second ignition coil dwell are supplied synchronous with an engine position. The method further comprises ceasing to supply the second ignition coil dwell time to the second ignition coil in response to an engine operating condition. The method includes where the engine operating condition is an engine EGR amount that is less than a threshold engine EGR amount. The method includes where the engine operating condition is an engine air-fuel ratio richer than a threshold air-fuel ratio.

In other examples, the method of FIG. 9 provides delivering spark to an engine, comprising: supplying two different ignition coil charging current times via a single conductor, the two different ignition coil charging current times supplied to a first ignition coil and a second ignition coil; and discharging the first ignition coil and the second ignition coil to a single spark plug. The method further comprises converting the two different ignition coil charging current times into two ignition coil commands. The method further comprises operating two ignition coil drivers in response to the two ignition coil commands. The method includes where a first ignition coil charging current time is provided to the first ignition coil and where a second ignition coil charging current time is provided to the second ignition coil, and further comprising an over dwell precaution control that resets the second coil to an off state.

In another example, the method further comprises supplying the first ignition coil charging current time at a first engine crankshaft angle and supplying the second ignition coil charging current time at a second engine crankshaft angle. The method includes where the first engine crankshaft angle is retarded from the second engine crankshaft angle. The method includes where the first engine crankshaft angle is advanced from the second engine crankshaft angle.

In another example, the method of FIG. 9 provides spark to an engine, comprising: supplying a first ignition coil charging current time to a first ignition coil via a first conductor; supplying a second ignition coil charging current time to a second ignition coil via a second conductor; and discharging the first ignition coil and the second ignition coil to a single spark plug. The method includes where the first ignition coil charging current time is provided via a first pulse width that is greater than a first threshold time. The method includes where the second ignition coil charging current time is provided via a second pulse width that is less than a second threshold time. The method includes where the second conductor also carries ignition coil charging current times for a plurality of engine ignition coils.

In some examples, the method includes where first ignition coil charging current time and the second ignition coil charging current time are supplied synchronous with an engine position. The method further comprises ceasing to supply the second ignition coil charging current time to the second ignition coil in response to an engine operating condition. The method includes where the engine operating condition is an engine EGR amount that is less than a threshold engine EGR amount. The method includes where the engine operating condition is an engine air-fuel ratio richer than a threshold air-fuel ratio.

As will be appreciated by one of ordinary skill in the art, routines described in FIG. 9 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but it is provided for ease of illustration and description. The methods and sequences described herein may be provided via executable instructions stored in non-transitory memory of a control in the system or systems described herein. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A method for providing spark to an engine, comprising:

supplying a first ignition coil charging current time to a first ignition coil of a cylinder based on a first signal changing state, the first signal provided via a first conductor;

supplying a second ignition coil charging current time to a second ignition coil of the cylinder in response to a state of a second signal and a state of the first signal, the second signal provided via a second conductor, where the second conductor also carries ignition coil charging current times for a plurality of ignition coils supplying spark to cylinders other than the cylinder, and wherein the second conductor is in communication with the second ignition coil and the plurality of ignition coils supplying spark to cylinders other than the cylinder; and discharging the first ignition coil and the second ignition coil to a single spark plug.

2. The method of claim 1, where the first ignition coil charging current time is provided via a first pulse width that is greater than a first threshold time.

3. The method of claim 2, where the second ignition coil charging current time is provided via a second pulse width that is greater than the first threshold time.

4. The method of claim 1, where the first ignition coil charging current time and the second ignition coil charging current time are supplied synchronous with an engine position.

5. The method of claim 1, further comprising ceasing to supply the second ignition coil charging current time to the second ignition coil in response to lean combustion while continuing to supply the first ignition coil charging current time to the first ignition coil.

6. A system for supplying spark to an engine, comprising:

a first ignition coil pre-driver circuit included in an engine controller, the engine controller apart from an ignition system;

interpretive logic for a cylinder that is in electrical communication with the first ignition coil pre-driver circuit via a first conductor, the interpretive logic included in the ignition system and configured to select one pulse from a plurality of pulses during an engine cycle as a basis for operating a second ignition coil driver circuit;

two ignition coil driver circuits including the second ignition coil driver circuit in electrical communication with the interpretive logic and two ignition coils, the two ignition coils in electrical communication with a single spark plug of the cylinder;

a second ignition coil pre-driver circuit included in the engine controller and in electrical communication with the interpretive logic and interpretive logic for a plurality of engine cylinders other than the cylinder via a second conductor; and executable instructions stored in non-transitory memory of the engine controller to supply a first of the two ignition coils a charging current time via the first conductor, and to supply a second of the two ignition coils and a plurality of ignition coils charging current times via the second conductor, the plurality of ignition coils supplying spark energy to cylinders other than the cylinder.

7. The system of claim 6, further comprising executable instructions stored in non-transitory memory of the engine controller to discharge one or more ignition coils in response to engine operating conditions.

8. The system of claim 7, further comprising additional executable instructions to discharge the one or more ignition coils in response to an air-fuel ratio.

9. The system of claim 8, where the first ignition coil pre-driver circuit is in electrical communication with only one ignition coil driver circuit of a plurality of ignition coil driver circuits.

10. The method of claim 1, where the state of the second signal is a transition from a first level of the second signal to a second level of the second signal, and where the state of the first signal is a transition from a first level of the first signal to a second level of the first signal.

11. A method for providing spark to an engine, comprising:

charging a first ignition coil of a cylinder in response to a first signal changing state, a first signal provided via a first conductor;

charging a second ignition coil of the cylinder in response to a second signal changing to a first state and the first signal changing to a second state, the second signal provided via a second conductor, where the second conductor also carries ignition coil charging current times for a plurality of ignition coils supplying spark to cylinders other than the cylinder, and wherein the second conductor is in communication with the second ignition coil and the plurality of ignition coils supplying spark to cylinders other than the cylinder; and discharging the first ignition coil and the second ignition coil to a single spark plug.

12. The method of claim 11, where the charging of the second ignition coil begins in response to the second signal being in the first state for a predetermined amount of time and the first signal being in the second state for a predetermined amount of time.

13. The method of claim 12, further comprising continuing to charge the second ignition coil after the first signal changes state from the second state.

* * * * *